US008191546B2

(12) United States Patent
Romine et al.

(10) Patent No.: US 8,191,546 B2
(45) Date of Patent: Jun. 5, 2012

(54) FLUE TUNING AND EMISSIONS SAVINGS SYSTEM

(76) Inventors: Grady L. Romine, Littleton, CO (US); Ronald E. McQueen, Park City, UT (US); Gerald R. Bivens, Sr., Broomfield, CO (US)

( * ) Notice: Subject to any disclaimer, the term of this patent is extended or adjusted under 35 U.S.C. 154(b) by 776 days.

(21) Appl. No.: 12/284,216

(22) Filed: Sep. 19, 2008

(65) Prior Publication Data

US 2009/0101131 A1 Apr. 23, 2009

(51) Int. Cl.
*F23J 13/00* (2006.01)

(52) U.S. Cl. ..... 126/297; 126/296; 126/285 R

(58) Field of Classification Search ..... 126/285 R, 126/292, 293, 307 A, 307 R, 312, 314, 315
See application file for complete search history.

(56) References Cited

U.S. PATENT DOCUMENTS

| | | | | | |
|---|---|---|---|---|---|
| 164,712 | A | * | 6/1875 | Bowman | 165/96 |
| 172,914 | A | * | 2/1876 | Culveyhouse | 126/296 |
| 403,672 | A | | 5/1881 | Humphrey | |
| 346,794 | A | | 8/1886 | Whitmarsh | |
| 368,485 | A | * | 8/1887 | Oblinger | 126/296 |
| 393,313 | A | * | 11/1888 | Romang | 126/296 |
| 589,610 | A | | 9/1897 | McPhaill | |
| 713,055 | A | * | 11/1902 | Burton | 126/296 |
| 1,319,621 | A | | 10/1919 | Roughen | |
| 1,417,987 | A | | 5/1922 | Griffith | |
| 1,438,611 | A | | 12/1922 | Ryerson | |
| 1,794,724 | A | | 3/1931 | Meyer | |
| 1,837,581 | A | | 12/1931 | Peterson | |
| 1,840,621 | A | | 1/1932 | Howie | |
| 1,891,600 | A | | 12/1932 | Lancaster | |
| 1,966,360 | A | | 7/1934 | Schaffer | |
| 1,971,336 | A | | 8/1934 | Butler | |
| 2,180,212 | A | | 11/1939 | Morrow | |
| 2,222,663 | A | | 11/1940 | Handley | |
| 2,244,936 | A | | 6/1941 | Bird | |
| 2,359,465 | A | | 10/1944 | Coburn et al. | |
| 2,611,361 | A | | 9/1952 | Lockhart | |
| 2,734,501 | A | | 2/1956 | Fauser, Jr. | |
| 2,735,385 | A | | 2/1956 | Ascentiis | |
| 2,882,023 | A | * | 4/1959 | Rizzo | 165/299 |
| 3,736,961 | A | | 6/1973 | Walsh | |
| 4,009,705 | A | | 3/1977 | Smith | |

(Continued)

*Primary Examiner* — Kenneth Rinehart
*Assistant Examiner* — Jorge Pereiro
(74) *Attorney, Agent, or Firm* — Ramon L. Pizaro; Edwin W. Crabtree

(57) ABSTRACT

A flue tuning and emissions saving system is disclosed. The device or system includes an inlet duct (20) having an inlet cross-sectional area and an outlet duct (18) having an outlet cross-sectional area that is the same as the inlet cross-sectional area. An outer duct (16) that is of an outer duct cross-sectional area is sealingly connected to the inlet duct (20) and the outlet duct (18), while separating the inlet duct (20) and the outlet duct (18). At least one disc (12) that is positioned at a specified distance S between the inlet duct (20) and at the same S to the outlet duct (18) and centered in the outer duct, the disk (12) includes a specified disc area so that flow of an exhaust gas entering the system through the inlet duct (20) will be diverted by the disc (12) into the outer duct (16) before the flow continues to the outlet duct (18) without encountering a restriction in flow cross-sectional area. When two or more discs are used, an annular fin (22) that extends from the outer duct to create a passage of the inlet duct (20) diameter that separates the discs.

1 Claim, 11 Drawing Sheets

Saver III Design

U.S. PATENT DOCUMENTS 4,079,727 A 3/1978 Smith
4,136,676 A * 1/1979 McCown et al. ..... 126/292
4,187,833 A 2/1980 Zahora et al.
4,215,814 A 8/1980 Ebert
4,249,883 A * 2/1981 Woolfolk ..... 431/20
4,291,671 A 9/1981 Senne
4,318,367 A * 3/1982 Antonucci ..... 122/20 B
4,320,869 A 3/1982 Elbert
4,334,897 A * 6/1982 Brady et al. ..... 96/356
4,337,892 A * 7/1982 Diermayer et al. ..... 236/93 R
4,372,289 A * 2/1983 Funke ..... 126/292
4,373,510 A 2/1983 Smith
4,497,310 A * 2/1985 Funke ..... 126/292
4,499,891 A 2/1985 Seppamaki
4,524,754 A 6/1985 Schubert
4,603,681 A 8/1986 Clawson
4,681,085 A 7/1987 Clawson
RE32,671 E 5/1988 Seppamaki
4,751,910 A 6/1988 Allen et al.
4,803,931 A * 2/1989 Carson ..... 110/163
4,836,184 A 6/1989 Senne
4,850,336 A 7/1989 Hagan
RE33,077 E * 10/1989 Van Dewoestine ..... 110/203
4,953,535 A 9/1990 Hagan
5,005,428 A 4/1991 Tanis
5,411,013 A 5/1995 Kazen
5,666,942 A 9/1997 Kazen
5,772,774 A 6/1998 Chabot
5,857,324 A * 1/1999 Scappatura et al. ..... 60/274
6,159,429 A * 12/2000 Bemel ..... 422/177
6,422,179 B2 7/2002 Hughes et al.
6,564,902 B1 * 5/2003 Saberi ..... 181/237
6,890,149 B2 5/2005 Metz et al.
6,955,756 B2 * 10/2005 Fallon ..... 210/131
6,974,303 B2 12/2005 Wang
7,104,359 B1 * 9/2006 Zelinski ..... 181/264
7,451,854 B2 * 11/2008 Suzuki et al. ..... 181/237
7,610,993 B2 * 11/2009 Sullivan ..... 181/268
2007/0095605 A1 * 5/2007 You ..... 181/256

* cited by examiner

KNOWN ART (US PATENT 4,836,184 TO SENNE)

Saver III Design

FLUE TUNING AND EMISSIONS SAVINGS SYSTEM

REFERENCE TO RELATED APPLICATIONS

This application claims the benefit of my provisional application having Ser. No. 60/994,994, filed Sep. 24, 2007, which discloses substantially the same materials as disclosed in my co-pending Patent Cooperation Treaty application having the same tiled and having serial number PCT/US2008/010850, filed Sep. 18, 2008.

BACKGROUND OF THE INVENTION (a) Field of the Invention

This application relates to a multiple system and methods for controlling the flow and residence time of gases and emissions through an exhaust flue. More particularly, but not by way of limitation, to an adjustable co-axial flue flow adjustment system.

(b) Discussion of Known Art

It is well recognized that adjusting the residence time of the exhaust gases moving along the flue can optimize the efficiency of devices such as furnaces. Optimized combustion results in reduced harmful emissions, such as carbon monoxide, shorter on cycles, longer off cycles and reduction in the amount of fuel and electricity consumed. However, the problem of how to achieve this optimization has proven difficult to solve due to the unpredictable nature of fluid flows and to limitations imposed by regulatory authorities.

As to regulatory limitations, flue ducting may not be restrictive in any location. This means that the cross-sectional area of the flue may not be reduced anywhere along the flue. Thus, the problem of how to increase residence time of the exhaust gases while reducing emissions traveling along the flue, without introducing restrictions to the flow.

Some known examples include U.S. Pat. No. 4,836,184 to Senne and U.S. Pat. No. 4,499,891 to Seppamaki provide baffles that extend into the flow, and thus disturb the laminar flow in order to create turbulence and increase the residence time of the flow within the flue. The tuning of these known devices is carried out by simply increasing or decreasing the extension of the baffle in order to increase or decrease the projected area of the baffle as seen by the flow.

Other known devices include U.S. Pat. No. 5,666,942 to Kazen and U.S. Pat. No. 5,411,013 to Kazen. The approaches in these devices was to increase residence time by placing a spiral ribbon in a section of flue duct, and thus force the flow to follow the ribbon in order to increase the residence time of the exhaust gases in the flue. Kazen's devices, along with other known prior art, because they were installed directly within the exhaust system and not within an expansion system, are restrictive by design and prohibited under regulatory guidelines.

Problems associated with known devices include that due to the fact they work well in only certain boiler systems, and not in forced air systems, and visa-versa. For instance the device to Senne was relatively simple to install in industrial boilers, but difficult to install in home applications, where forced air systems are more predominant. Senne's applications for boiler systems could be pre-calculated or pre-set for providing optimal performance to a specific boiler system, but had to be tuned in the field for forced air systems. This in turn required that highly trained technicians be used for home applications. Still further, home applications are typically found in tight spaces, which can rule out the use of the Senne device.

Still further, as shown in FIG. 1, in the design of the Senne device the minimum flow area is along the plane of the plate to the top of the plate, and then in a plane to the top of the 45-degree shoulder. This presents an important drawback in that modifications to improve the minimum area are at a cost of reduced system performance; conversely, larger plate sizes for increased performance violate the nonrestrictive design requirement.

Accordingly, the specific requirements for the configuration for application to both home and industry are:

1. Comply with the accepted standard that all exhaust ductwork not be restrictive in any location. This translates to the statement that the minimum flow area in the device be greater than the inlet duct area, $A_{min}/A_{inlet} \geqq 1.0$;
2. Do not reduce the draft by 50%, stay in the range of 20 to 30%.
3. Maintain furnace temperatures $T_{furnace} \leqq 250°$ F.
4. For home use provide a fixed position of the deflector plate inside the disclosed invention in order to use as is, and also to provide a safety measure which prevents untrained installers from altering the device. For industrial use, provide capability for adjustable vernier settings.
5. Reduce the footprint in recognition of the tight spacing of the home exhaust duct network.
6. Installation of the disclosed invention shall be no closer than 1 foot from the exit of the gas fired appliance.
7. Construction is made of stainless steel in order to combat corrosion.
8. Absolutely no leakage.
9. Absolutely nothing can come loose and fall down the flue.
10. Maintain open area without screens/porous baffles, which can clog with soot.
11. Use standard size ducts and connections for ease of installation.
12. Design and manufacture the product so that no retrofitting to the gas fired appliance is required at the time of installation
13. Provide capability for both draft hood systems and induction fan systems.

The last requirement implies a wide range of capability of the configuration. This will necessarily force two examples that include the inventive aspects disclosed here, since the two systems operate quite differently. The two applications will be addressed in the system performance section.

SUMMARY

It has been discovered that the problems left unanswered by known art can be solved by providing a flue tuning and emissions saving system that includes:

An inlet duct having an inlet cross-sectional area;

An outlet duct having an outlet cross-sectional area that is the same as the inlet cross-sectional area;

An outer duct that is of an outer duct cross-sectional area, the outer duct cross-sectional area being greater than the inlet cross-sectional area and the outlet cross-sectional area, the outer duct being sealingly connected to the inlet duct and the outlet duct, while separating the inlet duct and the outlet duct; and at least one disc that is positioned at a specified distance S between the inlet duct and at the same S to the outlet duct and centered in the outer duct, the disk having a specified disc area so that flow of an exhaust gas entering the system through the inlet duct will be diverted by the disc into the outer duct before the flow continues to the outlet duct without encountering a restriction in flow cross-sectional area. When two or more discs are used, an annular fin 22 that extends from the outer duct to the inlet duct diameter separates the discs.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
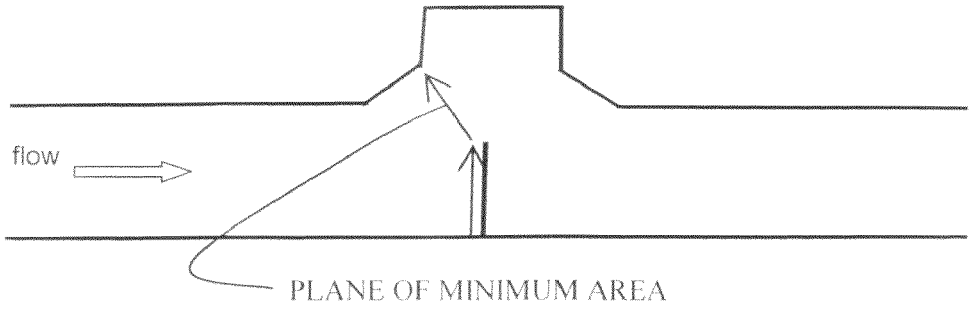
FIG. 1 is a schematic of known systems.
Figure 2:
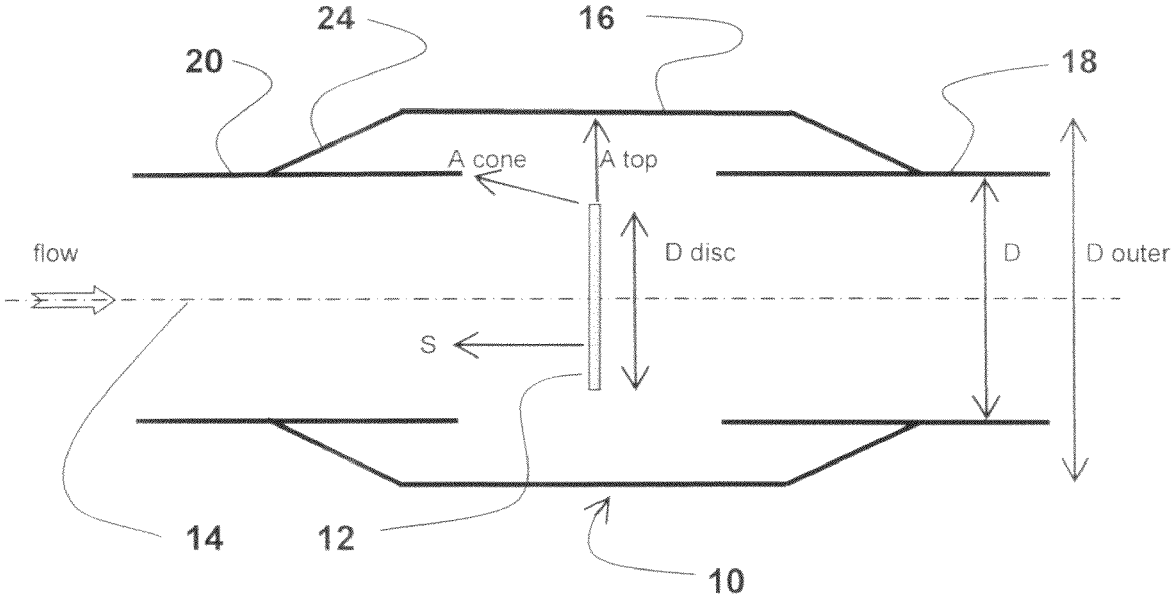
FIG. 2 is a section of a highly preferred embodiment of the disclosed invention.
Figure 3:
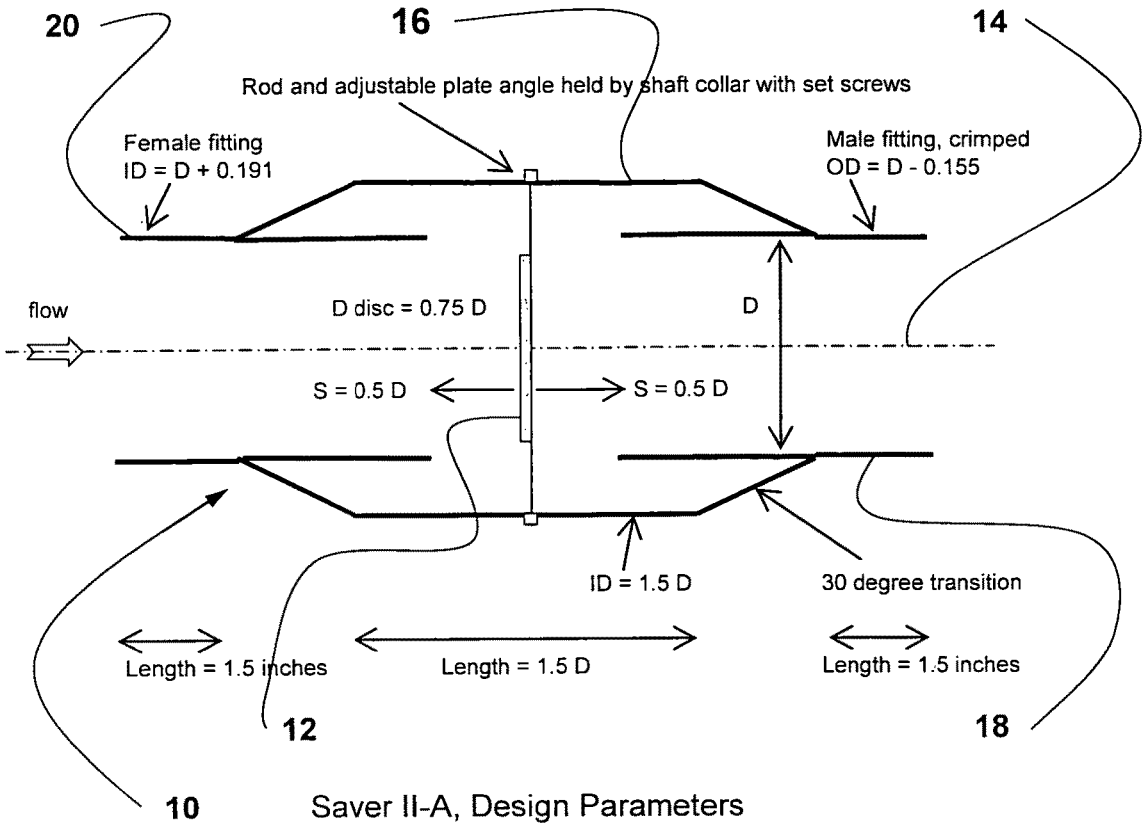
FIG. 3 illustrates the proportions of the highly preferred embodiment of FIG. 2.
Figure 3A:
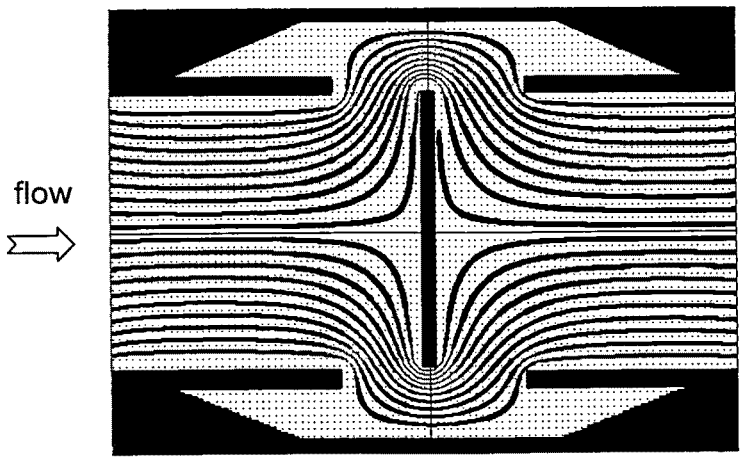
FIG. 3A shows a set of streamlines from an inviscid fluid dynamics publication listed as Reference 4, below.

Turning now to FIG. 2 where the disclosed invention 10 (also referred to herein as "Saver II") has been illustrated including an axisymmetric configuration can accomplish the required flow redirection in much less space than with known devices. It is preferred that the disclosed invention will be made from cylindrical sections, and thus the cross-sectional area increases by the square of the diameter of each section, and thus the minimum area can be controlled directly by the maximum outer diameter of the device. A simple disc 12 along the centerline 14 deflects the flow radially outward, while the outer duct 16 turns the flow aft to go behind the disc 12 and on down to the outlet duct 18. FIG. 3A show set of streamlines from an inviscid fluid dynamics code [4]. The flow redirection effects of the disc, the outer shell, and the constraints of the inlet duct 20 and outlet duct 18 are clearly seen, and are the primary design variables.

The parameters that can be varied in order to optimize the performance are shown in FIG. 2 and include: 12 the disc diameter $D_{disc}$, which in turn controls the disc area, 16 the outer duct diameter $D_{outer}$, which controls the outer duct cross sectional area, the length of the outer duct, the transition angle 24 of the outer duct, and most importantly, the standoff distance S between the inlet duct, outlet duct, and the disc.

The minimum flow area in the device relative to the duct flow area is the lesser of the cylindrical area at the top of the disc (2.1), or the area between the disc and the duct outlet/inlet which is calculated as the curved surface area of the frustum of a right cone (2.2).

$$(A_{min}/A_{inlet})_{top} = (D_{outer}/D)^2 - (D_{disc}/D)^2 \tag{2.1}$$

$$(A_{min}/A_{inlet})_{cone} = \left(1 + \frac{D_{disc}}{D}\right)\sqrt{\left(\frac{2S}{D}\right)^2 + \left(1 - \frac{D_{disc}}{D}\right)^2} \tag{2.2}$$

For the case $D_{disc}$=D, $A_{cone}$ is the circumferential area πDS.

The variation shown below of $A_{min}/A_{inlet}$ with $D_{outer}$ and D illustrate the benefits of an axially symmetric design. Diameters in inches, and $D_{disc}$=D.

| D | $D_{outer}$ | $A_{min}/A_{inlet}$ | S |
|---|---|---|---|
| 4 | 5.75 | 1.066 | 1.066 |
| 4 | 6 | 1.25 | 1.25 |
| 4 | 6.25 | 1.441 | 1.441 |
| 4 | 6.5 | 1.64 | 1.64 |
| 4 | 7 | 2.0625 | 2.0625 |

Design Choices

The specific dimensions and parameters of the design are dictated by their performance such that the design choices must be based upon either analysis or experiment. Analytical methods are only starting to be used for this type of problem, but code costs, set up time, checkout time, run costs, and validation efforts rule out an analytical approach; therefore, design guidance is obtained experimentally.

Performance of the Disclosed Invention

The exhaust ductwork is a classic problem of fluid flow in pipes. The fundamental equations between two points in the pipes are; from [1], the continuity equation in terms of the volume flowrate Q is shown in (3.1)

$$Q = A_1V_1 = A_2V_2 \tag{3.1}$$

The energy equation expressed for isothermal flow of a perfect gas becomes the Bernoulli equation [5, p90]. When an accounting of non isentropic loss effects are included through the loss coefficient K, the balance of total pressures is:

$$p_t = p_1 + \frac{1}{2}\rho V_1^2 = p_2 + \frac{1}{2}\rho V_2^2 + K\frac{1}{2}\rho V_1^2 \tag{3.2}$$

We assume here incompressible flow such that the density does not change significantly from the reservoir to any point, $$\rho_0 \approx \rho_1 \approx \rho_2 = \rho.$$

Pressure Drop Across the Disclosed Invention

The term K is a measure of the pressure drop from non isentropic changes from friction, expansion, turning, and turbulence, and is normalized by the dynamic pressure at the inlet $$q_1 = \frac{1}{2}\rho V_1^2.$$

The loss term K is additive [2] and is determined by the length between points 1 and 2 as well as the number and kinds of bends, valves, fittings, or diameter changes. For typical hardware, the most detailed definition of the contribution of these factors is in the Crane handbook [3]. For the disclosed invention design the K values must be obtained analytically or experimentally. Reforming (3.2) for the local K of the disclosed invention, we find:

$$K_{Saver\,II} = \frac{\frac{1}{2}\rho V_1^2 - \frac{1}{2}\rho V_2^2 + (p_1 - p_2)}{\frac{1}{2}\rho V_1^2} = \frac{q_1 - q_2 + (p_1 - p_2)}{q_1} = \frac{p_{t1} - p_{t2}}{q_1} \tag{3.3}$$

The pressures and dynamic pressures can be measured in the duct on both sides of the disclosed invention through static pressure taps on the duct walls, and pitot probes located at the centerline of the duct.

Experimental Data

A bench test setup was constructed to measure the static and pitot pressures using a manometer board. A four inch duct was supplied by a two horsepower fan which has two speed settings. Various test sections and deflector plate shapes were installed and tested.

The pitot tube measures total pressure relative to ambient pressure $p_\infty$, and the static pressure is also relative to ambient:

$$P_{pilot} \equiv P_t = p + \frac{1}{2}\rho V^2 - p_\infty,\ P_{static} \equiv P = p - p_\infty \tag{3.4}$$

The dynamic pressure upstream to the test section is $$\frac{1}{2}\rho V_1^2 = P_{t1} - P_1,$$

and $K_{SaverII}$ is then defined by the measurements as:

$$K_{Saver\,II} = \frac{P_{t1} - P_{t2}}{P_{t1} - P_1} \tag{3.5}$$

The Senne design was tested extensively in order to improve its performance. Thirty variations in the plate size and shape were tested. After 9 checkout runs, 78 initial tests were conducted on a commercial T test section which had two intersecting cylinders without the 45 degree transition. The Senne design itself was used for 18 subsequent tests. The next 171 tests of the disclosed invention design were then conducted to provide design guidance, for definition of its performance, and for comparison with the Senne design. The disclosed invention was investigated in 24 tests, giving a total of 300 tests for the disclosed invention development.

Figure 6:
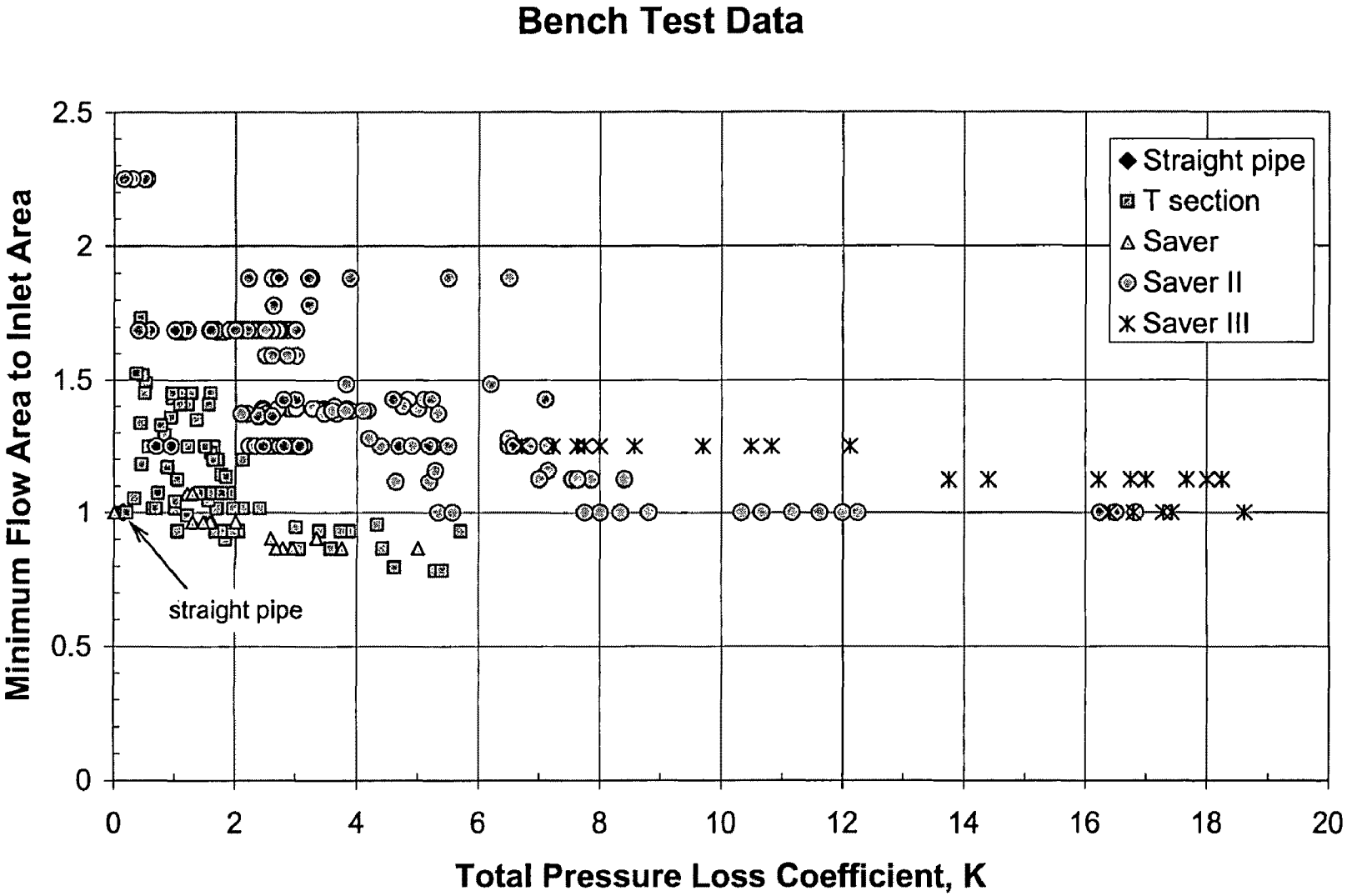
FIG. 6 illustrates bench data for pressures losses measured on known devices and examples disclosed herein.

The performance of each configuration tested is measured by K and also by the minimum flow area to duct area $A_{min}/A_{inlet}$. For the Senne design the areas are calculated by the two planes discussed above: a partial circular area up to the top of the plate, and one half of an elliptical area from the plate top to the 45 degree transition. For the disclosed invention, equations (2.1) and (2.2) are used. FIG. 6 presents a collection of the data obtained from the bench tests. The disclosed invention design has two configurations; disclosed invention-A for atmospheric systems with a draft hood, and disclosed invention-F for forced systems with fans. The two different applications have separate requirements for performance improvements.

The most striking fact revealed by the data is that the disclosed invention design has excellent performance for K, while the ratio $A_{min}/A_{inlet}$ is controlled by design to be greater than one. The Senne design was restrictive and limited in design options to meet all of the design requirements, while the Saver II offers a great deal of design latitude and a wide range of application.

4.0 Saver II Design 4.1. Dual Designs. For optimum performance improvement, applications to a draft hood system require K values around 3.0, while systems with an induction fan require K values approximately 16 times larger for the same performance improvement. The test data does not show K values this large so the induction fan systems will have reduced performance improvement compared to the draft hood system. The test data derived optimum designs for the Saver II-A, the Saver II-F, and the Saver III are listed below.

4.2. Saver II-A. The draft hood version illustrated in FIG. 3 can be satisfied with a number of disc sizes, so the approach here is to maximize $A_{min}/A_{inlet}$ which lowers the disc size. For K averaged over 16 data points $K_{SaverII\text{-}A}$=2.4351, the normalized dimensions are then:

$$A_{min}/A_{inlet} = 1.6875,\quad D_{disc} = \frac{3}{4}D$$
$$D_{outer} = 1.5D \qquad \theta_{adapter} = 30°$$
$$s = 0.5D \qquad L_{outer} = 1.5D$$

Provision is made to adjust the plate angle for vernier control if necessary, and a locking mechanism is in place to secure the settings. If necessary, additional control can be achieved with longer S values and smaller disc diameters. The range of these parameters is contained within the bench test data scatter in FIG. 6.

4.3. Saver II-F. The induction fan version, illustrated in FIG. 4 must have the maximum possible K factor in order to overcome the reduction of K due to the fact that fan outlets are designed to be smaller than the duct diameter, typically one half. The K relationship is:

$$K_{fan} = K_{duct}\left(\frac{D_{fan}}{D_{duct}}\right)^4 \cong \frac{K_{duct}}{16}.$$

The goal is also to be away from the restrictive limit with a flow area greater than the inlet, or $A_{min}/A_{inlet}>1.0$. The test data of FIG. 6 show that a great deal of performance improvement is possible with the single disc configuration of the disclosed invention-A design by changes to the disc diameter and to the standoff or separation distance S. Consequently, a large number of tests were conducted varying these parameters. These are the largest points shown in FIG. 6 for the Saver II. The maximum single disc K values are expected to be $K_{SaverII\text{-}F}=7.6166$, and the normalized dimensions are then:

$$A_{min}/A_{inlet}=1.125,\ D_{disc}=1.0625D$$

$$D_{outer}=1.5D\ \theta_{adapter}=30°$$

$$s=0.28125D\ L_{outer}=1.5D$$

4.4 Saver III. It is also important to note that for even higher performance, we will utilize the principle of the disclosed invention design and go to a design shown in FIG. 5 with a double disc separated by an outer diameter fin 22. These are the $K_{SaverIII}$ points shown in FIG. 6. As seen in FIG. 6 the disclosed invention has very high performance at the cost of minimum flow area. Without going to even more discs, the maximum double disc K values are expected to be $K_{SaverIII}=17.1549/16$, and the normalized dimensions are then:

$$A_{min}/A_{inlet}=1.10,\ D_{disc}=D$$

$$D_{outer}=1.5D\ \theta_{adapter}=30°$$

$$s=0.25D\ L_{outer}=1.5D$$

$$ID_{fin}=D\ OD_{fin}=1.5D$$

Figure 7:
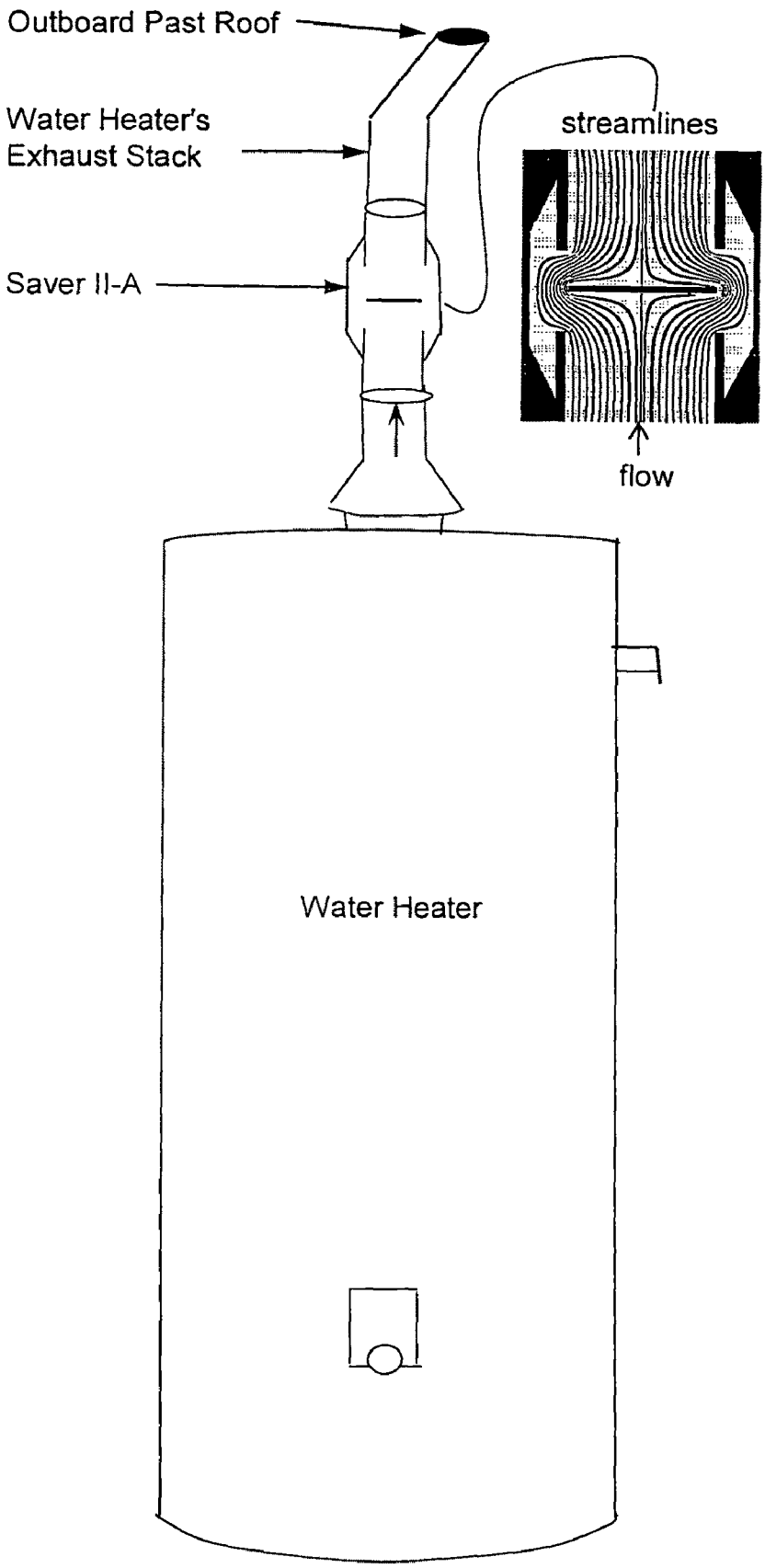
FIG. 7 illustrates the disclosed invention in use with a water heater.
Figure 7A:
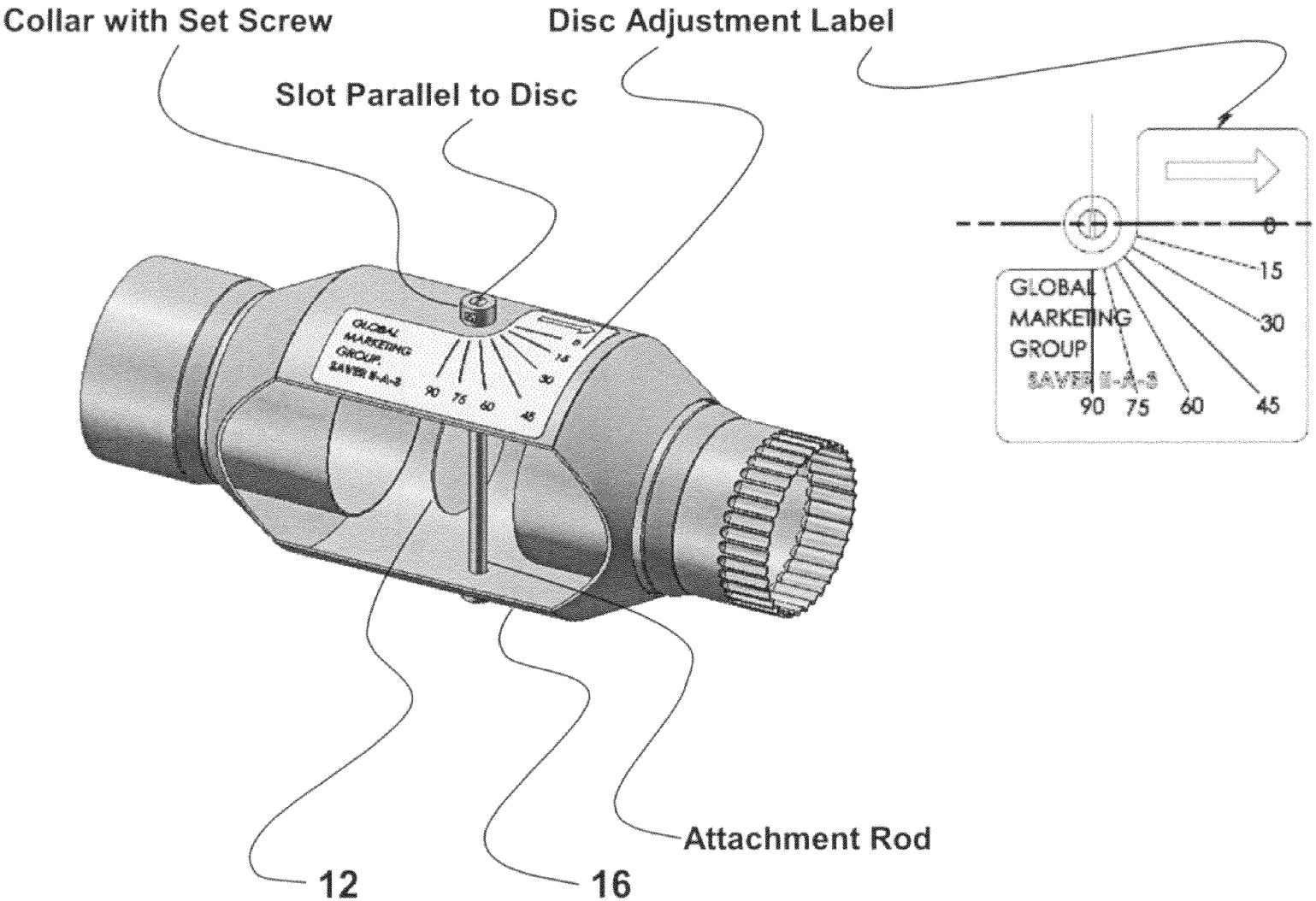
FIG. 7A is a view looking into a 3-D cut-away section of the invention outer duct, illustrating the mounting of the disc on the supporting rod, a slot at the top of the rod which is parallel to the disc to allow viewing of the angle of the disc, and the disc adjustment label.

4.5. Flue Tuning. For all Savers, provision is made to adjust the plate angle for vernier control if necessary, and a locking mechanism is in place to secure the settings. These features are shown in FIG. 7A. If necessary, additional control can be achieved with longer S values and smaller disc diameters. The range of these parameters is contained within the bench test data scatter in FIG. 6.

Construction

For all designs, the inlet female fitting and outlet male fitting are sized to attach to standard duct sizes with a minimum of 0.125 inches gap. In addition, in order for the device to fit properly during installation, the male fitting is crimped (following standard practice for ductwork). The 30 degree transition 24 is based upon a standard ductwork adapter going from D to 1.5D. All seams are welded so that no gas can escape under pressure. The material is 304L stainless steel in order to combat corrosion, and the thickness is 20 Gauge. Savers for ducts greater than 8 inches will be thicker, 18 to 16 Gauge.

The discs are welded to the front of the rods and are centered along the axis. The standoff distance S refers to the distance from the disc face to the inlet/outlet ducts. This makes the rods slightly off center. The shaft collars have a set screw to hold the rod at the desired angle setting. The bottom shaft collar has a closed end to prevent slippage of the rod during the initial setting at installation. After installation, the set screws are securely tightened and the top shaft collar is covered with a push nut.

System Operation

The performance of the disclosed invention installed in a facility is dependent upon its integrated performance. Each facility will have its own characteristics and fuel savings will vary. Two examples are demonstrated in this section; a typical home furnace of 100000 Btu per hour output, and a typical home water heater of 35500 Btu per hour. FIG. 7 illustrates the placement of the Saver II-A in a water heater exhaust stack.

For every cubic feet of natural gas, 1040 Btu of heat is released; thus, 1.603 cfm of natural gas is used in the furnace and 0.569 cfm in the water heater. Burners operating at the stoichiometric air to fuel ratio produce 9.8648 ft3 of combustion products for each ft3 of fuel. This translates to 17.41 cfm in the furnace flue and 6.18 cfm in the water heater flue. Operation off the stoichiometric value will produce greater amounts.

The furnace has injector nozzles to supply the stoichiometric vales (s.v.) of air and also an opening at the burner box which supplies excess air. The total for this example is 160% for the furnace. The water heater draws in about 150% at the burner but this amount is roughly doubled at the top of the heater by the draft hood, FIG. 7, thus operates at around 288%.

Furnace Operation

The furnace induction fan is assumed to operate wide open at 200% of the stoichiometric value and has a maximum total pressure of 0.1175 inches of water. The system characteristic is $$P_t = K_{flue}\left(\frac{1}{2}\rho V^2\right)_{flue}$$

and intersects the fan characteristic at 26.9 cfm. The addition of the disclosed invention-F gives a system characteristic of $$P_t = (K_{flue} + K_{Saver\ II-F})\left(\frac{1}{2}\rho V^2\right)_{flue}.$$

The ductwork K coefficient for the furnace system is outlined in Crane [3] with the value $K_{flue}=0.655$. As mentioned above, the Saver K coefficient is reduced by the different pipe IDs, fan to duct, [3]:

$$K_{fan} = K_{Saver\ II}\left(\frac{D_{fan}}{D}\right)^4$$

Figure 8:
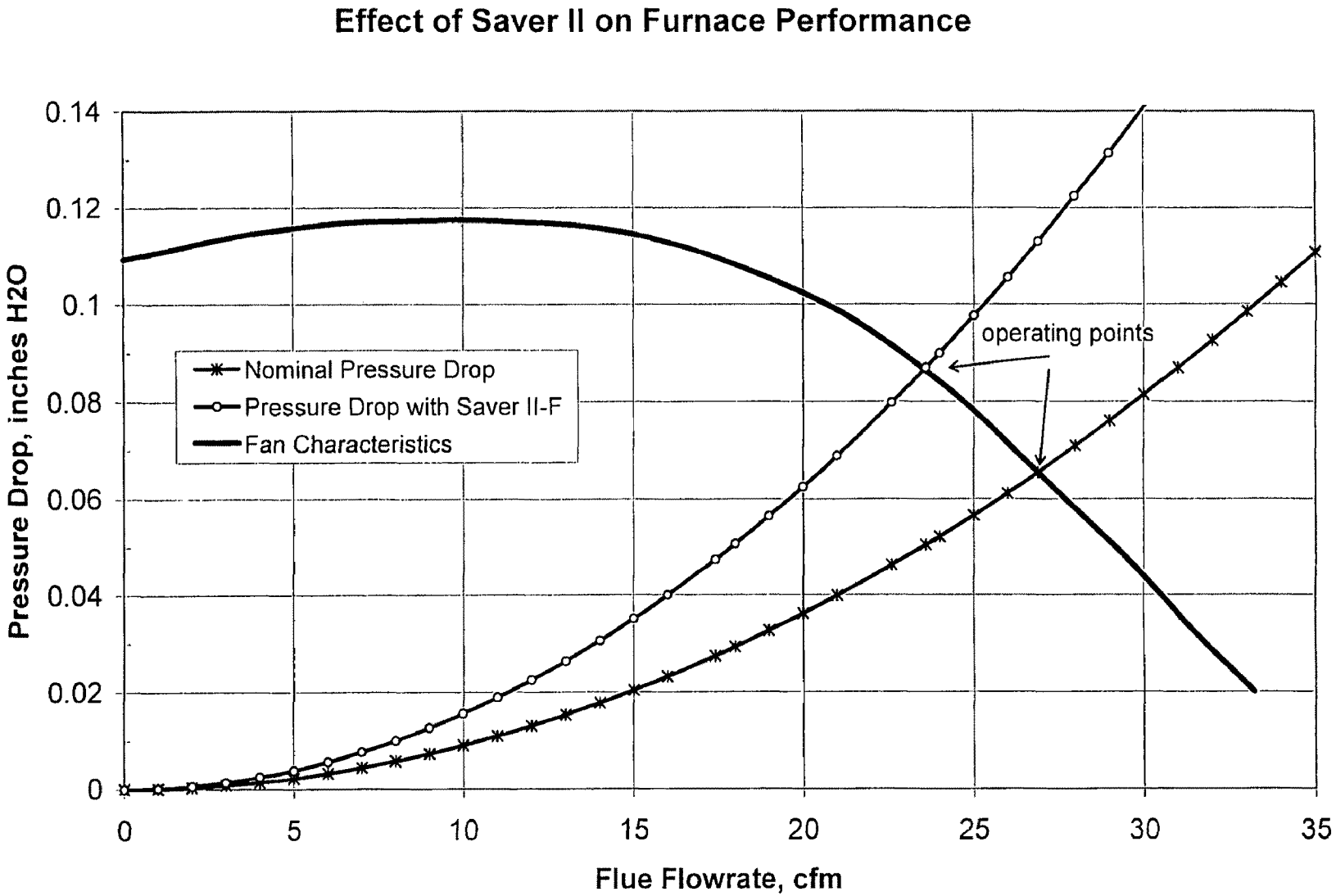
FIG. 8 illustrates the effect of the disclosed invention on furnace performance.

Thus, for a 2 inch fan outlet and a 4 inch duct, and using the experimentally derived coefficient $K_{SaverII\text{-}F}=7.6166$ we have $K_{fan}=7.62/16=0.476$. The resulting system performance is shown in FIG. 8.

The effect of adding the disclosed invention to a typical home furnace system is a reduction of the gas flow and emissions up and out of the flue. This example shows that the flowrate is reduced to 23.6 cfm, or 83.7% of the pre-installation value of 26.9 cfm. The 23.6 cfm represents 139.1% of the s.v. and is much more efficient. The fuel savings realized is addressed below in Energy Savings.

Water Heater Operation

The water heater burner is assumed to operate at 150% of the stoichiometric value. After combustion, the gases rise up in an internal flue or standpipe typically about 5 feet in length and 4 inches in diameter. Most models have flue baffles, much like a twisted ribbon, which distribute the heat to the walls to further supply heat to the surrounding water tank. The increased surface area is included in the K factor. At the top of the standpipe a flue restrictor redirects the flow axially into a 6-inch draft hood and then into a smaller 3-inch vent pipe. The static pressure at the standpipe exit is slightly below ambient therefore the draft hood draws in an amount of air that roughly doubles the flowrate to around 288%.

The ductwork K coefficient for the water heater system is computed from [3] with the value $K_{w.h.flue}$=3.88. From the bench tests, the disclosed invention-A coefficient is $K_{SaverII\text{-}A}$=2.4351. The water heater system characteristic is $$P_t = K_{w.h.flue}\left(\frac{1}{2}\rho V^2\right)_{w.h.flue}$$

and intersects 16.67 cfm at a head loss of 0.0294 inches of water. Adding of the disclosed invention-A gives a system characteristic of $$P_t = (3.88 + 2.435)\left(\frac{1}{2}\rho V^2\right)_{w.h.flue}.$$

Figure 9:
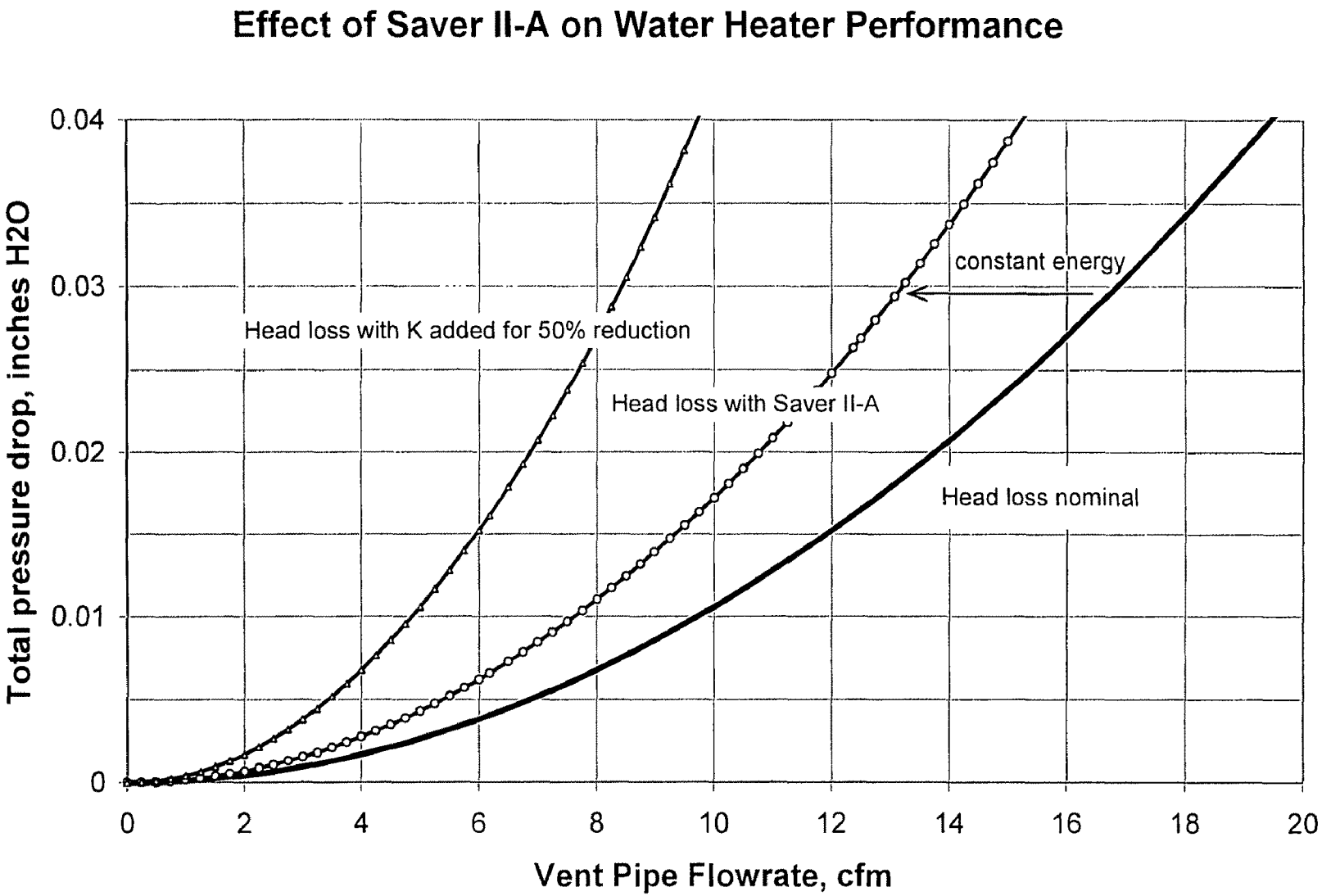
FIG. 9 illustrates the effect of the disclosed invention on water heater performance.

Without a fan, the system energy remains the same and the flow rate is reduced to 13.07 cfm as shown in FIG. 9. The effect of adding the disclosed invention to a typical home water heater system is a reduced flow rate to 13.07 cfm, or 78.4% of the pre-installation value of 16.67 cfm. Also, the 13.07 cfm represents 115.4% of the s.v. and is very much more efficient. The specific fuel and energy savings realized from the disclosed invention-A is addressed in the following section.

Energy Savings

Addition of the disclosed invention reduces the burn time of the appliance (through increased heat transfer in the heat exchanger due to increased velocities and increased driving temperatures), reduces the oxygen content in the exhaust with more efficient combustion, and consequently reduces the stack losses. The savings is in the cost of the fuel as well as the cost of fan electricity, but most significantly in the reduction of $CO_2$, CO, $SO_2$, and $NO_x$ out the stack. The measure of all savings is through the energy saved by reducing losses out the flue. The energy of the flue system is obtained by the power of the throughput. Power is proportional to the cube of the speed, which relates to the duct flow rate through (3.1). Consequently the energy saved from addition of the disclosed invention device is:

$$E_{Saver\,II}(\%) = \frac{Q_1^3 - Q_{Saver\,II}^3}{Q_1^3}\cdot 100 = \left[1 - \left(\frac{Q_{Saver\,II}}{Q_1}\right)^3\right]\cdot 100 \tag{6.1}$$

6.1. Induction Fan Boilers. For these applications, the disclosed invention "Server II-P※ is used and the example shown in FIG. 3 shows a savings of $E_{SaverII\text{-}F}$=32.88%.

$$E_{Saver\,II-F}(\%) = \left[1 - \left(\frac{23.55}{26.897}\right)^3\right]\cdot 100 = 32.8786$$

Significant savings of induction fan systems are more difficult to obtain and require application of a different design than draft hood systems 6.2. Atmospheric Boilers. The draft hood system of the water heater is in a general class of atmospheric boilers of any size. The example of FIG. 9 and (6.1) shows that after installation of the disclosed invention in atmospheric boilers, referred to here as the "Saver II-A※, the energy savings is $E_{SaverII\text{-}A}$= 51.84%.

$$E_{Saver\,II-A}(\%) = \left[1 - \left(\frac{13.0679}{16.6721}\right)^3\right]\cdot 100 = 51.8444$$

Note that the flow rate is reduced by 21.6% and if the system needs to be at 20% the angle adjustment can be used to lower the K value.

6.3. General Relationship. For induction fan systems, the fan characteristics dictate the change in power and are more difficult to model. For draft hood systems, we have a given flow rate $Q_1$ in the flue and the pressure drop is $$K_{flue}\frac{1}{2}\rho V_1^2.$$

With increased resistance to the system the system pressure drop is the same for draft appliances, and the velocity and flow rate must decrease to $V_S$ and to $Q_S$:

$$K_{flue}\frac{1}{2}\rho V_1^2 = (K_{flue} + K_{Saver\,II})\frac{1}{2}\rho V_S^2.$$

The draft flow rate reduction of the disclosed invention is thus relative to the K of the flue.

$$\frac{Q_S}{Q_1} = \sqrt{\frac{K_{flue}}{K_{flue} + K_{Saver\,II}}} \tag{6.2}$$

The energy savings of the disclosed invention-A then becomes:

$$E_{Saver\,II-A}(\%) = \left(1 - \left(\frac{K_{flue}}{K_{flue} + K_{Saver\,II-A}}\right)^{1.5}\right)\cdot 100 \tag{6.3}$$

6.4. Reduction of Excess Air. The savings can also be related to the changes of the excess air through the changes in the stoichiometric value. This is especially useful to avoid over correcting the system and reducing safety margins (like requirement #2).

Figure 10:
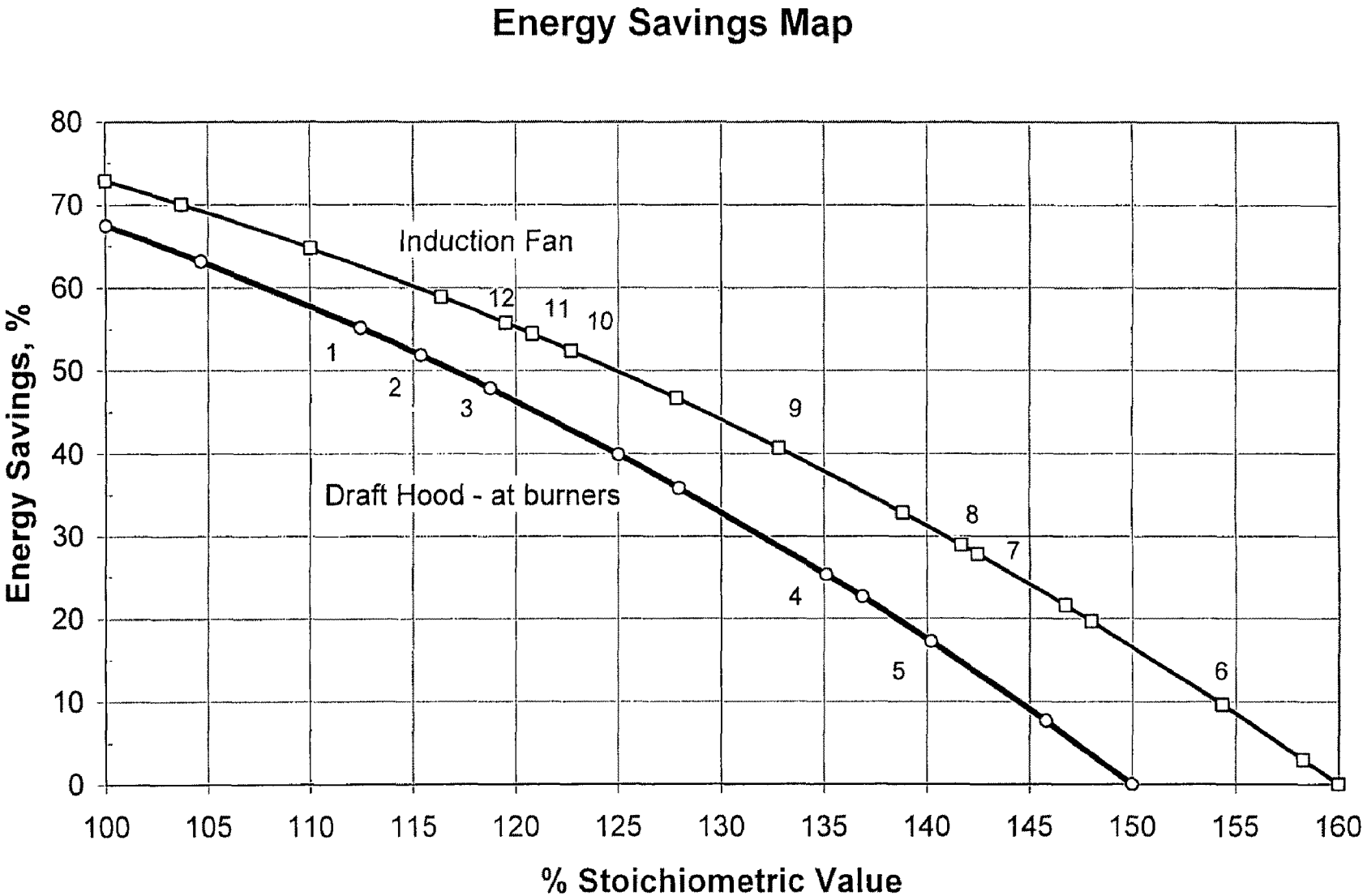
FIG. 10 is a map comparing savings to percent stoichiometric value of the flue gases.

Combining (6.1) with the system characteristic we can construct a savings map and show the effect of the various design choices in FIG. 10 (along with the accompanying table).

The specific points illustrated in FIG. 10 are listed in the Table below with the configuration details of each point. Included are: the average $K_{Saver}$, the number of data points in the average, the minimum flow area to duct area, the disc diameter to duct diameter, the separation distance S/D, and the % savings. The goal is to balance the highest savings along with the highest ratio $A_{min}/A_{inlet}$ and yet not to dampen the % s.v. to unacceptable levels. The chosen configurations are noted with an *. The effect of no disc is listed in points #5 and #6.

Figure 4:
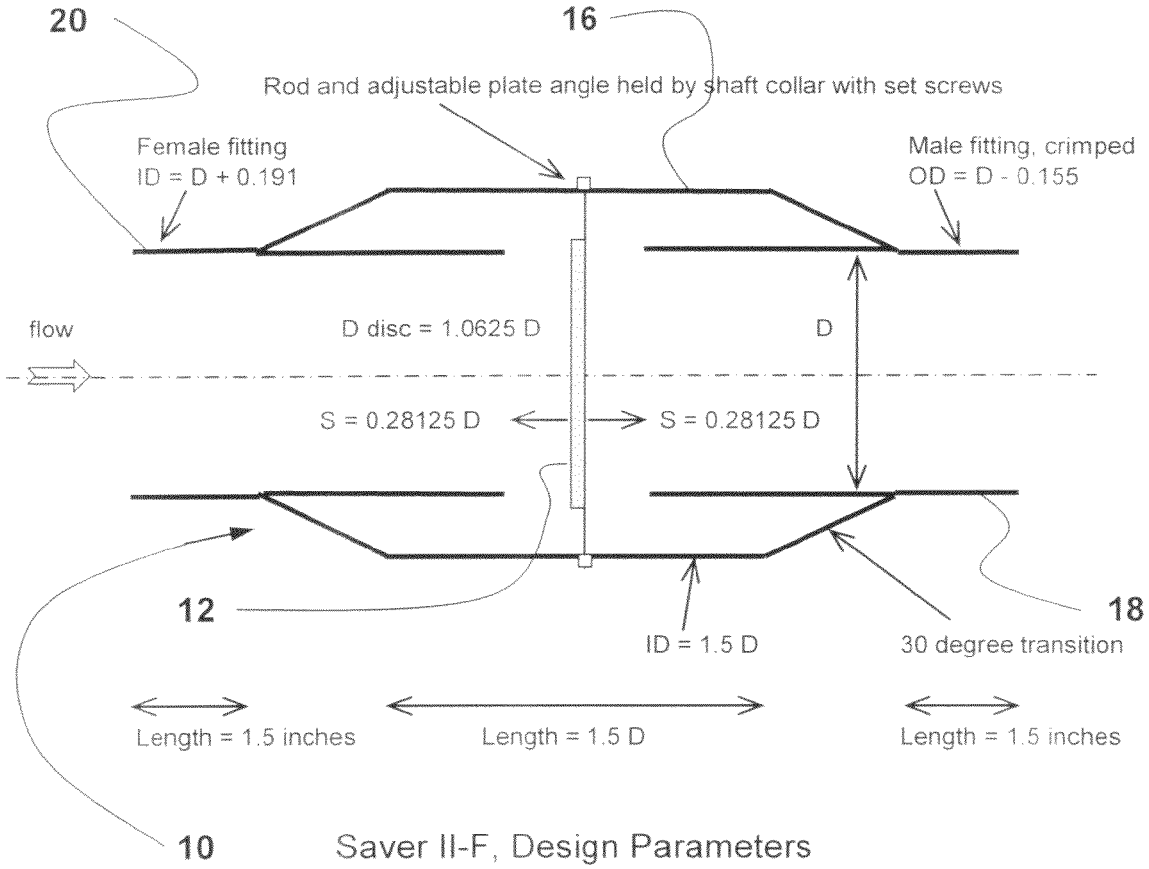
FIG. 4 illustrates a variation of the example shown in FIG. 2.
Figure 5:
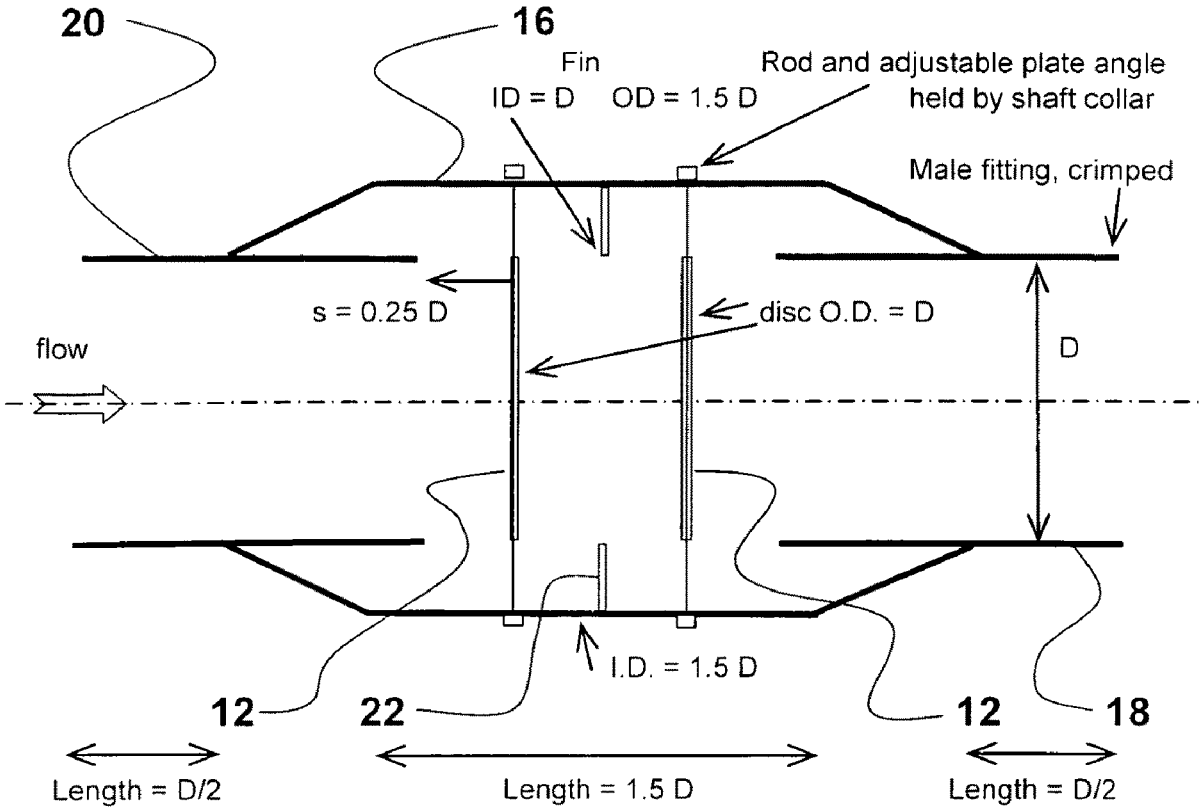
FIG. 5 illustrates an embodiment that incorporates inventive principles disclosed herein.

| Example | $K_{Saver}$ | no. | $\frac{A_{min}}{A_{inlet}}$ | $\frac{D_{disc}}{D}$ | $\frac{S}{D}$ | % Savings | |
|---|---|---|---|---|---|---|---|
| 1. | FIG. 3 2.7393 | 4 | 1.59252 | 0.75 | 0.4375 | 55.13 | |
| 2.* | FIG. 3 2.4351 | 16 | 1.6875 | 0.75 | 0.5 | 51.84 | |
| 3. | FIG. 3 2.1082 | 7 | 1.6875 | 0.75 | 0.5625 | 47.85 | |
| 4.* | FIG. 3 0.8348 | 4 | 1.6875 | 0.75 | 0.5 | 25.35 | disc at 0° |
| 5. | FIG. 3 0.5227 | 2 | 2.25 | 0 | 1.0 | 17.27 | no disc |
| 6. | FIG. 4 0.5227/16 | 2 | 2.25 | 0 | 1.0 | 3.00 | no disc |
| 7. | FIG. 4 4.4778/16 | 6 | 1.4256 | 0.875 | 0.375 | 21.61 | |
| 8. | FIG. 4 6.1034/16 | 4 | 1.25 | 0.5 | 0.3125 | 27.84 | |
| 9.* | FIG. 4 7.6166/16 | 8 | 1.125 | 1.0607 | 0.28125 | 32.88 | |
| 10. | FIG. 4 12.559/16 | 12 | 1.0 | 1.1181 | 0.375 | 46.68 | |
| 11. | FIG. 5 16.505/16 | 8 | 1.125 | 1.0607 | 0.28125 | 54.42 | |
| 12. | FIG. 5 17.155/16 | 6 | 1.0 | 1.1181 | 0.25 | 55.73 | |

The design for disclosed invention shown on FIG. 3 is chosen from point #2 since it has a very large flow area to duct area and a range that can accommodate most systems. Points 2 and 4 illustrate the range that the disclosed invention shown on FIG. 3 has for on-site adjustment as the disc goes from normal to the flow in #2 to be aligned with the flow in #4. The disclosed invention shown on FIG. 5 will have a more limited range due to the closeness of the inlet/outlet ducts. The resistance to the system without a disc is given in #5 and #6. The disclosed invention shown on FIG. 4 design is chosen from #9 since it has 12.5% more flow area than duct area. Point #10 has a greater savings, but it does not have any margin on flow area. The disclosed invention shown on FIG. 5 design also offers greater savings; however, it is more difficult to manufacture, and further #12 also has no flow area margin.

Installation Procedures

Installation. The disclosed invention devices are designed for two separate applications and should never be used for both. Installation of either device after the vent pipes are joined at a Y-junction should never be done. The disclosed invention-A is for draft hood appliances only, and the disclosed invention-F for induction fan appliances only.

Figure 11:
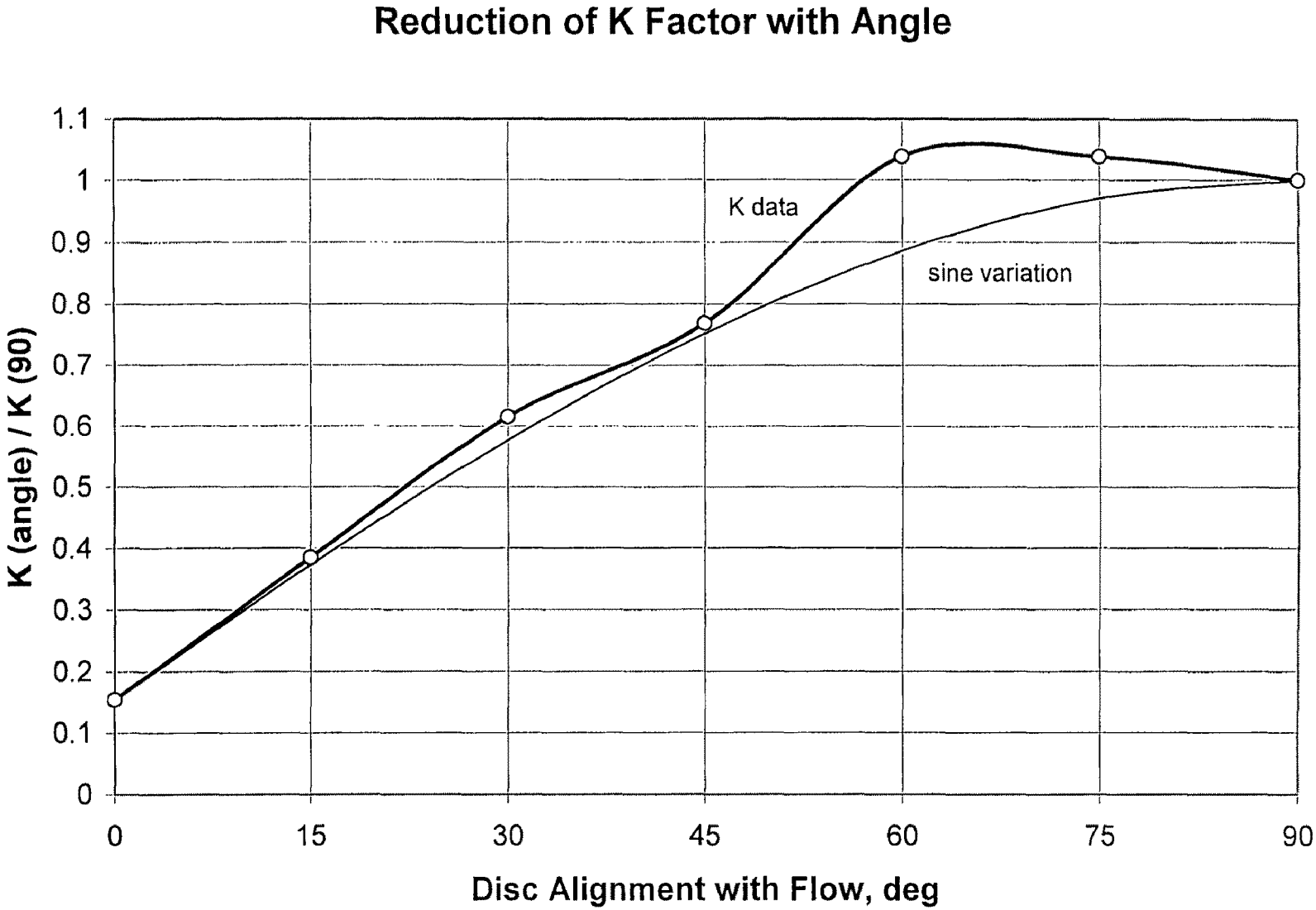
FIG. 11 is a graph illustrating the effect of the angle of the baffle plate in the disclosed invention and the loss coefficient "K".

Adjustments. The disclosed invention will come from the factory with the normal of the deflector disc aligned along the centerline. Adjustments to the K factor are accomplished by changing the angle setting on the disclosed invention, FIG. 7A. Only a certified HVAC installer should do this. Systems that are more efficient initially will need to have lower K values so that they do not have spillover at the draft hood or tax the induction fan past its maximum operating pressure drop. A normalized plot of the experimentally determined reduction with angle is shown in FIG. 11. The disclosed invention illustrated in FIG. 5 has angle adjustment at the second disc.

The angle nomenclature used here is that 90 degrees represents the disc normal to the flow. The angle sensitivity shown in FIG. 11 deviates from the expected sine variation due to a complicated stalling phenomenon. The first 45 degrees follows nicely that of a flow over a disc at an angle of attack.

Locking. After adjustment by an HVAC installer, the device should be locked from any further adjustments. This is to prevent untrained workers from attempts to increase performance to the point that a hazardous situation may result.

Maintenance. Annually the device should be inspected to assure that it is not clogged with soot or condensate build-up, and that the setting is appropriate. In addition, several system checks should be made to assure that the burners are cleaned and adjusted, that there is no CO build-up, that the ductwork is tight and without rust holes or corrosion, that there are no obstructions to the airflow inlet screens or panels, that the draft hood is clear of debris, that the draft hood is drafting properly, and that fresh intake air meets code.

Conclusions

The disclosed invention provides important benefits that could not be achieved with known devices. For the draft hood system, the disclosed invention as shown in FIG. 3 has a minimum flow area that is 68.75% greater than the duct area. This high value will add margin to the natural draft of the system. Induction fan systems are forced systems and can tolerate a lower value, such that the disclosed invention as shown in FIG. 4 has a minimum flow area that is 12.5% greater than the duct area. The designs and performance of both are determined experimentally. Both configurations offer savings in fuel, fuel costs, as well as a corresponding reduction of $CO_2$, CO, $SO_2$, and $NO_x$ along with additional savings in electricity and $CO_2$ in processing the saved electricity. The disclosed invention as shown in FIG. 4 saves 33%, while the disclosed invention as shown in FIG. 3 saves up to 51% as indicated by the bench test data.

Technical References Cited in Text

1. J. K. Vennard, *Elementary Fluid Mechanics,* $4^{th}$ Edition, Wiley and Sons, New York, 1962.

2. J. S. Kunkle, S. D. Wilson, and R. A. Cota, "Compressed Gas Handbook, Revised", NASA SP-3045, 1970.
3. Crane Co., "Flow of Fluids through Valves, Fittings, and Pipe", Technical Paper No. 410, Chicago, Ill., 1976.
4. J. Beeteson, *Viziflow*, version 2.3, www.viziflow.com, 2004. Development programme, Module 004 May 2003.
5. F. M. White, *Viscous Fluid Flow*, $2^{nd}$ Edition, McGraw-Hill, Inc. 1991.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A flue tuning system that includes:

an inlet duct having an inlet cross-sectional area, the inlet duct being adapted for accepting a fluid flow in a flow direction that is normal to the inlet cross-sectional area;

an outlet duct having an outlet cross-sectional area that is the same as the inlet cross-sectional area;

an outer duct that is of an outer duct cross-sectional area, the outer duct cross-sectional area being greater than the inlet cross-sectional area and the outlet cross-sectional area, the outer duct being sealingly connected to the inlet duct and the outlet duct, while separating the inlet duct and the outlet duct; and at least two discs that are spaced apart from one another, one of the discs being positioned at a distance S from the inlet duct and another at the same distance S from the outlet duct and centered in the outer duct, each disc having a specified disc area that is smaller than the outer duct cross-sectional area, the disc positioned at a distance S from the inlet duct being supported within the outer duct by an attachment rod that allows pivoting of the disc about an axis that is normal to the fluid flow direction, the attachment rod supporting the disc positioned at a distance S from the inlet duct in a spaced apart manner from the outer duct to create an area between the disc and the outer duct that is at least as large as the inlet cross-sectional area, and an annular fin that projects inwardly from outer duct, the annular fin being positioned between the discs, so that flow of an exhaust gas entering the system through the inlet duct will be diverted by the disc/fin/disc flow arrangement without encountering a restriction in flow cross-sectional area.

* * * * *